United States Patent [19]

Groover et al.

[11] Patent Number: 4,823,983

[45] Date of Patent: Apr. 25, 1989

[54] INCREASED COLUMN/SELECTIVITY VENDER

[75] Inventors: Phillip B. Groover, Woodstock; Paul A. Phillips, Marietta, both of Ga.

[73] Assignee: The Coca-Cola Company, Atlanta, Ga.

[21] Appl. No.: 105,044

[22] Filed: Oct. 6, 1987

[51] Int. Cl.[4] ..... G07F 11/34

[52] U.S. Cl. ..... 221/92; 221/150 R; 221/281; 312/36; 312/45

[58] Field of Search ..... 221/129, 150 R, 242, 221/281, 92; 312/45, 72, 236, 36

[56] References Cited

U.S. PATENT DOCUMENTS

| | | | |
|---|---|---|---|
| 1,736,057 | 11/1929 | Smith | 312/45 X |
| 2,785,828 | 3/1957 | Patzer | 221/129 X |
| 3,075,670 | 1/1963 | Brugger | 221/150 R X |
| 3,085,712 | 4/1963 | Skumawitz | 221/150 R |
| 3,498,497 | 3/1970 | Baxendale et al. . | |
| 4,171,066 | 10/1979 | Hirose . | |
| 4,245,755 | 1/1981 | Craven et al. . | |
| 4,287,992 | 9/1981 | Takemori | 312/45 X |
| 4,303,179 | 12/1981 | Spring . | |
| 4,380,130 | 4/1983 | Bachmann et al. . | |
| 4,423,828 | 1/1984 | Tanaka et al. . | |
| 4,456,147 | 6/1984 | Tominaga . | |
| 4,485,937 | 12/1984 | Adams . | |
| 4,561,564 | 12/1985 | Negishi . | |
| 4,586,633 | 5/1986 | Holland et al. . | |
| 4,632,257 | 12/1986 | Negishi et al. . | |
| 4,722,455 | 2/1988 | Groover . | |

*Primary Examiner*—F. J. Bartuska

*Attorney, Agent, or Firm*—Birch, Stewart, Kolasch & Birch

[57] ABSTRACT

A Serpentine vend rack structure is provided formed of hollow upright wall portions mounted in ported, laterally adjustable brackets over a refrigeration plenum such that the relative spacing between the wall portions is adjustable to accommodate articles of various sizes for vending. A plurality of shaped bosses on opposing wall portions define a serpentine path and include flow parts over a portion of those paths to permit circulation of refrigerated air from the plenum, up through the brackets and wall portions and out through the bosses to chill articles stored in the vend rack prior to vending. The upright hollow wall portions are internally partitioned to preclude the flow of refrigerated air beyond a desired level of the vend rack.

4 Claims, 3 Drawing Sheets

FIG. 5
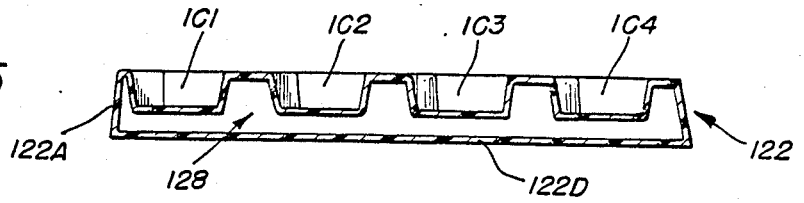
FIG. 6
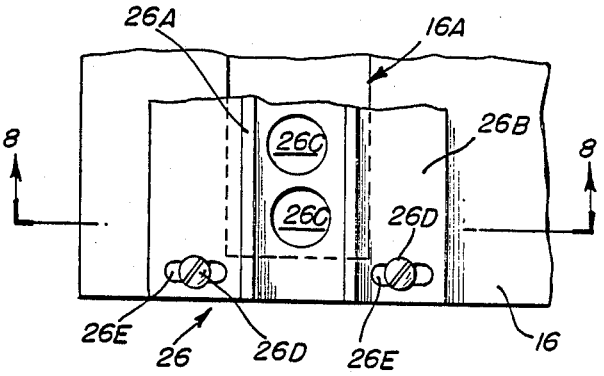
FIG. 7
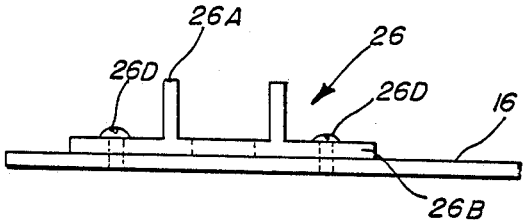
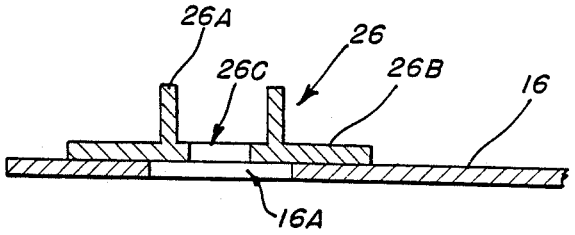
FIG. 8

INCREASED COLUMN/SELECTIVITY VENDER

BACKGROUND OF THE INVENTION

The present invention relates to vend racks for a vending machine that store softdrink bottles or cans and feed the same in a cooled condition to a discharge port in the front of a vending machine in a uniform manner. More specifically, the present invention relates to modular serpentine vend rack mechanisms having the flexibility of storing selected numbers of vendable bottles or cans in a plurality of separately accessible serpentine vend columns of different capacities.

One of the most widely used conventional vend racks for bottles and cans in a vending machine includes a plurality of side-by-side, vertical storage columns, each of which communicates with a discharge port in the front of a vending machine. The columns are disposed in parallel relationship, and the quantity of vendable products therein is usually controlled by dimensioning the width of the columns to receive either a double row of nestable bottles or cans or a single stacked row of bottles or cans. These columns may either be one-deep, two-deep or three-deep, depending on the depth on the vending machine cabinet. This conventional vend rack suffers from the disadvantage that there is little flexibility in choice of the number of vendable products that can be stored in the respective columns. Therefore, it is difficult to match product demand with storage capacity for any given column for a vending machine of this type which conventionally contains from five to nine selectable products and from seven to ten columns.

The demand for different types of products may depend on sales location or general popularity. In addition, in vending machines such as described in U.S. Pat. No. 4,380,130 to Bachmann, et al., issued Apr. 19, 1983 and assigned to the same assignee as the present invention, product sales or demand is also influenced, for example, by the unique styling of a given vending machine. For instance, if the vending machine includes the use of an enlarged primary product selection button adjacent the coin slot of the vending machine, there will be a distinct need for more flexibility in product storage and delivery from the respective chutes of a vend rack. This need is to accommodate the vending format of that machine. The need to match product demand with storage capacity exists, however, for all machines which vend multiple products.

One attempt to provide greater column selectivity in a vender is disclosed in U.S. Pat. No. 4,245,755 to Craven et al. In Craven, some increased selectivity is achieved by a communicating slant shelf extension of a column for which the storage capacity is to be increased. However, even the Craven apparatus has limited selectivity.

SUMMARY OF THE INVENTION

Accordingly, it is a primary object of the present invention to provide a modular serpentine vend rack configuration for a plural product vending machine having the ability to store and supply a large number of high-demand, high-selling, vendable products in one or more large-capacity serpentine vend column configurations, and to store and supply lower-selling vendable products in lower capacity serpentine vend column configurations.

It is further an object of the present invention to provide vend rack configurations with greater flexibility for the variation of storage capacities of different types of vendable products such as canned or bottled beverages within a machine of the same overall storage volume as conventional machines; and to provide adjustments therein to accommodate variations in can or bottle size.

It is yet another object of the present invention to provide a vend rack structure for use in a multiple-product vending machine which facilitates matching of the capacity of respective configurations of vend columns with product demand so that the respective chutes containing the different products will theoretically become empty about the same point in time, thereby reducing the number of service calls for refilling the machine.

It is still another object of the present invention to provide a vend rack which may be easily retrofit into existing vending machines which presently utilize conventional, vertical column vend racks.

The objects of the present invention are fulfilled by providing a vend rack structure for delivering vendable cylindrical products from a top loading position to a bottom dispensing position in a vending machine, comprising:

upright wall portions each having first means defining a plurality of serpentine paths thereon over a major extent of the vertical dimension thereof; second means defining a plurality of canted substantially horizontal chutes on said wall portions stacked one above the other and interconnecting the upper ends of respective ones of said serpentine paths to said top loading position at one side of a said wall portion; and bracket means in a said vending machine for slidably receiving each of said wall portions, permitting selective removal from and replacement thereof in said vending machine. The serpentine paths of adjacent ones of the said wall portions are mirror images of one another, jointly defining product columns extending from said top loading position to said bottom dispensing position, such that vendable products are jointly supported therebetween to traverse said product columns from said top loading position to said bottom dispensing position.

The bracket means of the present invention are adjustable laterally of the wall portions such that the said product columns defined therebetween will accommodate vendable products of selected lengths.

Furthermore, the wall portions are hollow and the first means for defining the serpentine paths comprises hollow bosses extending outward from each wall portion with surfaces thereon defining the serpentine paths. The respective interiors of the hollow bosses and wall portions are in communication in a given wall portion and also are adapted to receive a flow of air from the refrigerated plenum of an associated vending machine. The bosses are perforated or ported to a selected height above the bottom of each wall portion to direct a flow of refrigerated air over the product stacked to that height in the product columns. Additionally, if desired, internal flow preventing partitions are formed in the hollow interiors to preclude airflow above that preselected height.

In a preferred embodiment of the invention the adjustable brackets contain flow ports cooperating with flow ports in the top plate of the refrigerated plenum of the vending machine to direct air flow induced by the evaporator fan into the hollow interiors of the walls and bosses.

BRIEF DESCRIPTION OF THE DRAWINGS

FIG. 5 is a bottom plan view of the serpentine vend rack of FIG. 3;

FIG. 6 is a partial top plan view of an adjustable mounting bracket structure for the serpentine vend rack modules of the present invention mounted on the upper wall of a refrigerated plenum chamber of a vending machine;

FIG. 7 is a partial front elevation of the mounting bracket and plenum chamber wall of FIG. 6; and FIG. 8 is a cross-section taken along line 8—8 of FIG. 6.

DETAILED DESCRIPTION OF PREFERRED EMBODIMENTS

Figure 1:
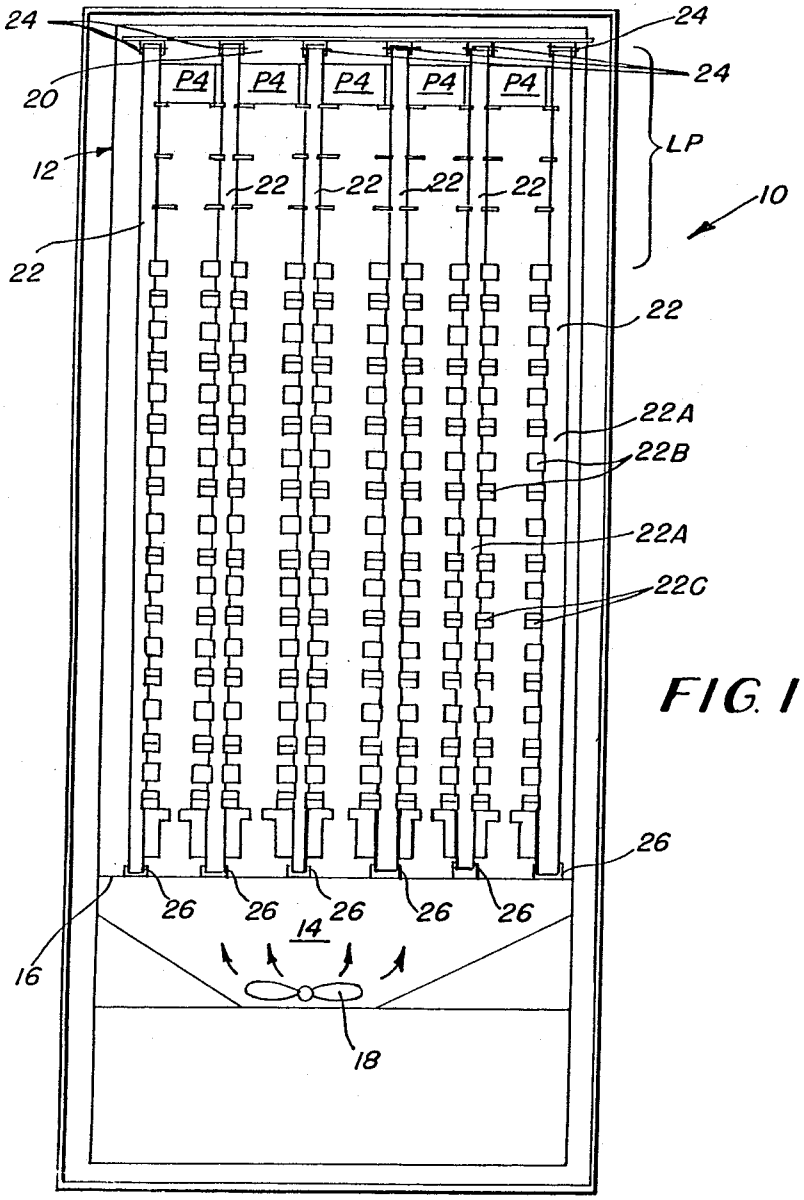
FIG. 1 is a diagrammatic front elevation of a plurality of serpentine vend rack modules of the present invention mounted within a vending machine.

The objects of the present invention and the attendant advantages thereof will become more readily apparent by reference to the following drawings wherein like numerals refer to like parts and wherein:

Referring in detail to the drawings and with particular reference to FIG. 1, a vending machine 10 is shown as incorporating a vending cavity 12, located above a refrigerated plenum chamber 14, from which it is separated by the upper wall 16 of the plenum chamber 14. The plenum chamber 14 is provided with an evaporator fan 18 which forces air upwardly in the direction of the arrows shown, for a purpose to be hereinafter more fully described. The uppermost reach of the vending cavity 12 is provided with a top plate 20 which is substantially coextensive and parallel with the upper wall 16 on the plenum chamber 14. Slide-in serpentine vending rack modules 22 are provided within the vending cavity 12 in an array to be more fully described hereinafter. These serpentine vending modules 22 are slidably mounted in upper and lower mounting brackets 24 and 26, respectively, which in turn are attached to the top plate 20 in the vending cavity 12 and the upper wall 16 of the plenum chamber, respectively.

Figure 2:
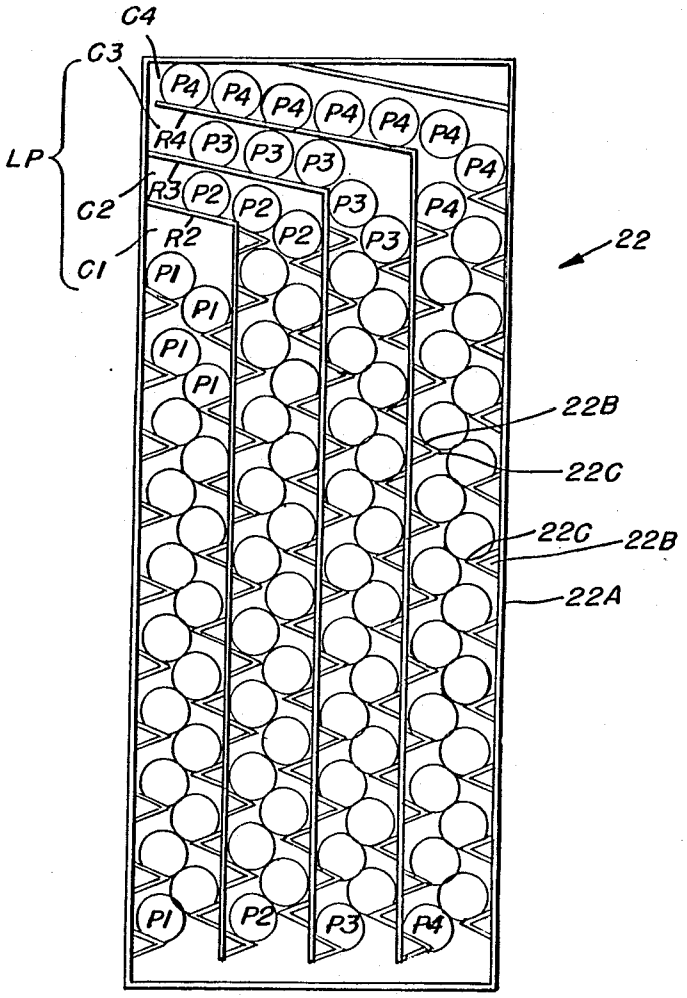
FIG. 2 is a side elevation of a four-deep serpentine vend rack module of the present invention with product containers loaded therein.

Referring to FIG. 2, the serpentine modules 22 each consist of four serpentine vend columns C1, C2, C3 and C4. Each of these columns comprises a substantially vertically disposed serpentine path with the columns C1 through C4 carrying products P1 through P4, respectively, with the respective columns varying in product capacity in the order of increasing number. In other words, column C1 contains less than column C2, which contains less product than column C3, which contains less product than column C4.

This difference in column capacity is achieved by means of sloped reaches defined by slightly canted, substantially horizontal surfaces R2, R3 and R4, respectively, defining the reaches for columns C2, C3 and C4. As a result, as may be observed from FIG. 2, column C1 holds 19 containers of the product P1, column C2 holds 22 containers of the product P2, column C3 holds 24 containers of the product P3 and column C4 holds 28 containers of the product P4. This is in the case where all of the product containers are of similar diameter, such as twelve ounce beverage cans.

As indicated jointly in FIGS. 1 and 2, each product column C1 through C4 is defined by a hollow vertical standard or wall portion 22A from which extend orthogonally disposed triangular bars 22B which are in an alternating pattern such that the apices 22C of the adjacent bars 22B are opposed and vertically spaced in an amount creating a serpentine path of travel for a product container traveling from top to bottom of a given product column C1–C4. It should be here noted that the reaches R2, R3 and R4 at the tops of the columns C2, C3 and C4, respectively, provide for a common loading area LP for all four of the columns C1-C4 since all of the columns terminate in a vertical stack adjacent an upper corner of the serpentine rack 22. This is clearly shown in FIG. 2.

Figure 3:
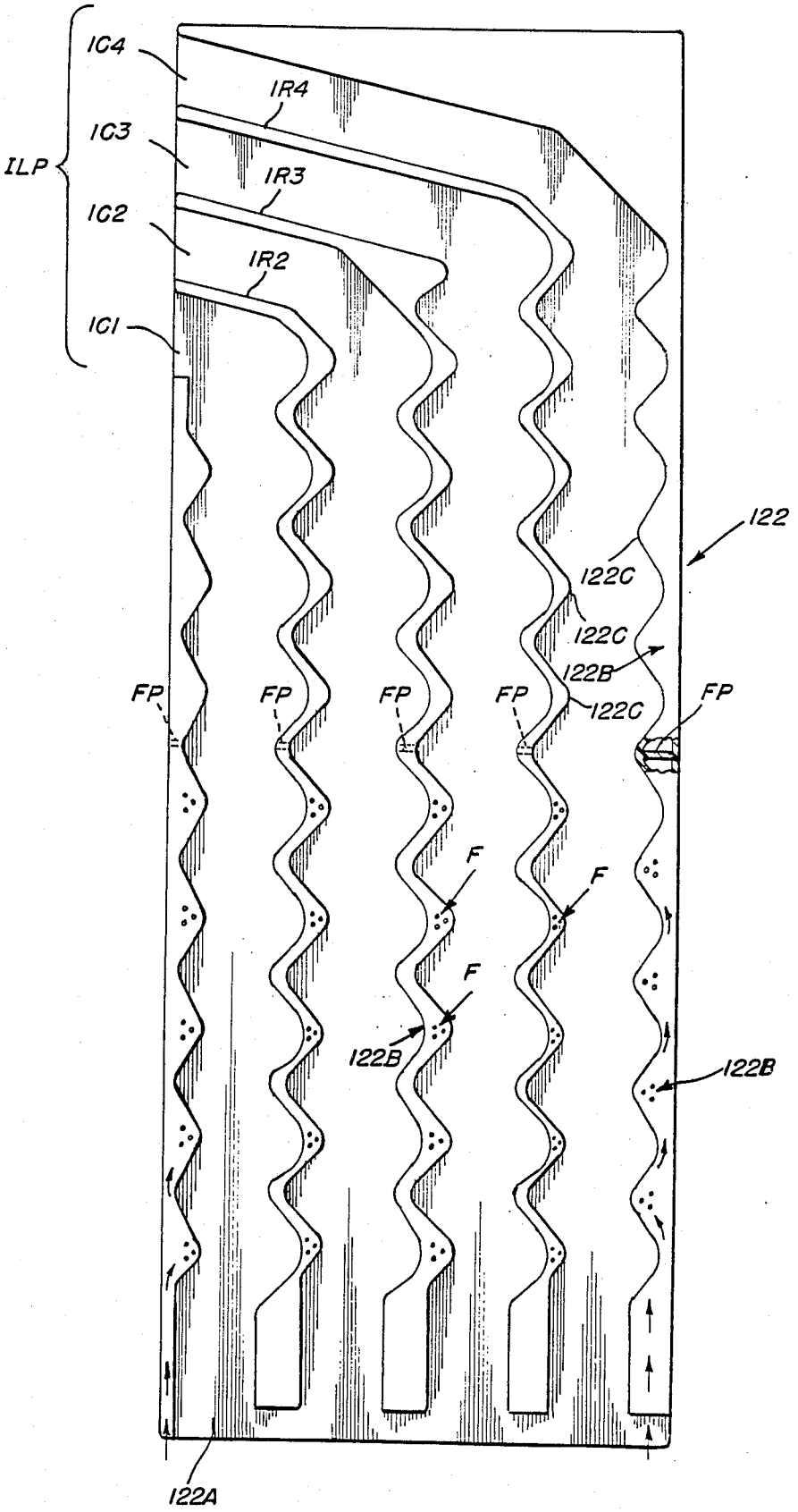
FIG. 3 is a side elevation of another embodiment of a serpentine vend rack module of the present invention.
Figure 4:
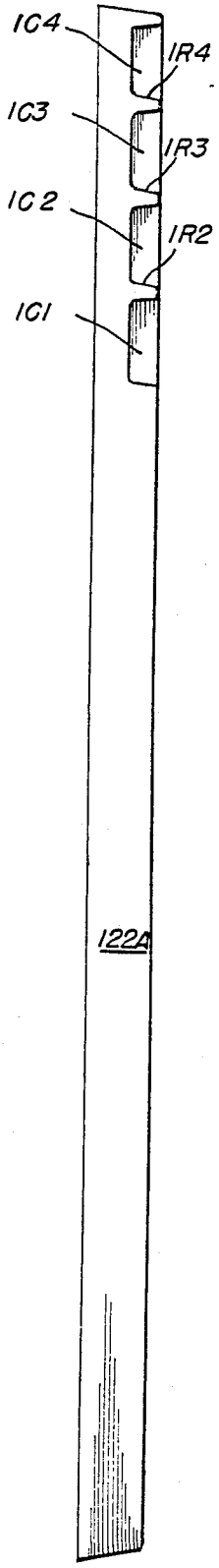
FIG. 4 is a front elevation of the serpentine vend rack of FIG. 3.

Referring next to FIGS. 3, 4 and 5, another preferred embodiment of the serpentine vend rack 122 of the present invention is shown as including a plurality of continuous serpentine bosses extending orthogonally from the vertical walls 122A to form smooth transitional triangular portions 122B having apices 122C, with adjacent apices 122C in a given stack being oppositely disposed and vertically staggered such that a smooth serpentine path is formed from top to bottom in the vertically disposed portions of each of the columns IC1, IC2, IC3 and IC4.

In a manner similar to that of the embodiment of FIGS. 1 an 2 the columns are all loaded from a common vertical loading position ILP defined by integral partitions IR2, IR3 and IR4 defining boundaries between the four columns ICI through IC4 and extending in a canted but substantially horizontal reach from the uppermost portion of the vertical extent of the said columns IC1 through IC4 to the said vertical loading position ILP.

Referring now to FIG. 5, in particular, the stanchion 122A forming the vend rack wall 122 is shown as being hollow at its lowermost portion to define an internal cavity 128 through which air may be forced to flow vertically within the vertical wall 122A through the cavity 128 by means of the evaporator fan 18 (shown in FIG. 1) as will be hereinafter more fully described.

In maintaining containers of beverage, such as those for the products P1 through P4 of the previous figures, in a chilled condition prior to dispensing, it is neither necessary nor efficient to chill the entire vending cavity of the vending machine and accordingly, the lower one-half or one-third of the vend racks only need be actively cooled.

Accordingly, a plurality of flow ports F are indicated as being drilled or formed in some or all of the substantially triangular portions 122B in the outermost surfaces thereof and a flow blocking partition FP is provided which extends laterally across the hollow structure 122A to preclude the flow of air from extending above that point. Alternatively, the lack of perforations in the upper one-half or upper two-thirds of the triangular portions 122B will cause the flow of cooling air across the containers in the racks only in the lower one half to one third of the racks as the case may be.

The hollow racks 122 are formed by blow molding or other similar techniques and a flat wall portion 122D such as illustrated in FIG. 5 may be formed across the back of those racks designed for use as outboard rack portions while mirror image blow molded racks may be formed together to provide multi-sided centrally located rack portions.

This may be also be observed in the embodiment of FIG. 1 in which the innermost rack portions 22 include the triangular portions 22B extending from both sides thereof. In this embodiment as well as in the embodiment of FIGS. 3 through 5, the vend racks are formed by a blow molding with mirror image halves to form the multi-sided rack portions while the two outside rack portions also comprise mirror images of one another.

Vacuum forming may also be used together with bonding techniques if the various rack portions are made in two or more parts.

In both embodiments, the vend racks are designed to be hollow. In the embodiment of FIGS. 1 and 2, selected ones of the triangular extensions 22B are open-ended or perforated to permit air flow therefrom across the cans held therebetween. These racks may also include a flow impeding internal partition such as the partition FP in the embodiment of FIGS. 3-5.

Referring next to FIGS. 6, 7 and 8, the adjustable features of the upper and lower mounting brackets 24 and 26 first described with respect to FIGS. 1 and 2 will now be more fully described.

With reference to FIGS. 6, 7 and 8, the lower mounting brackets 26A will be described since these brackets include air passages to permit flow of air into the hollow vertical standards or wall portions 22A and 122A in the various embodiments of the vend racks. The upper mounting brackets 24 are of substantially identical construction but do not require the presence of air vents therein.

The mounting brackets 26 are shown as including upstanding open channels 26A integrally formed on flat plates 26B extending outboard of the upturned portions of the channels 26A and lying flush against the upper surface of the top wall portion 16 of the refrigerated plenum 14. An elongated slot 16A is formed in the top plate 16 of the plenum 14, under each of the brackets 26, for the purpose of permitting air to flow vertically outward from the plenum 14 under the influence of the evaporator fan 18 as indicated by the arrows in FIG. 1 and as also indicated by the arrows in FIG. 3, although the plenum is not shown in FIG. 3.

Cooperating flow ports 26C are formed within the channel 26A in the bracket 26 and are in communication with the elongated slots 16A in the top plate 16 such that air flowing from the plenum will flow upward through the bottom plate 26B of the brackets 26 through the flow ports 26C formed therein.

The brackets are adjustable in a lateral direction, as indicated by the double ended arrows in FIGS. 6 and 7, by means of set screws 26D mounted in elongated laterally extending slots 26E in the base plate 26B of the brackets 26. These set screws 26D and slots 26E may be provided at desired intervals from the front to the back of the vending cavity 12 in the vending machine 10 as required for strength and security. Accordingly, as can be seen, the vend racks 22 and 122 are adapted to be slidably inserted into the brackets 26 and likewise, into the brackets 24, and slid into the vending cavity 12 of the vending machine 10. The brackets 26 are first adjusted by means of the set screws 26D and slots 26E to accommodate the proper distance between the vertical vend racks 22 and 122 to accommodate product cans P1 through P4 of any desirable length. In other words, the spacing between the vertical vend racks 22 or 122 is adjusted to accommodate the axial length of the product containers being dispensed.

DESCRIPTION OF OPERATION

With the vend racks 22 or 122, as the case may be, inserted into the mounting brackets 24 and 26, which have been previously adjusted to the proper length to receive products P1 through P4 in each of the columns C1 through C4, respectively, it should be noted that the vend racks 22 or 122 are preferably placed into the vend cavity 12 with the loading portions LP or ILP, respectively, facing outward of the vend cavity within the view of a person servicing and loading the machine. To load the machine, the service person simply places cans of product P1 through P4 in the respective columns C1 through C4 or IC1 through IC4, respectively, and permits the inserted containers to follow the serpentine vend rack path from the top loading position to the bottom thereof namely, the dispensing position, where they are engaged by conventional dispensing mechanisms (not shown). These mechanisms cooperate with the vending machine controls as is well known in the art to selectively dispense product from the bottom dispensing positions of various columns C1 through C4 and IC1 through IC4.

After the columns are full, the general configuration of the product within the vend racks of the present invention is illustrated in FIG. 2 with the canted reaches R2, R3 and R4 (also IR2, IR3 and IR4) filled with product as well as the vertically extending portions of the columns C1 through C4 (also IC1 through IC4).

Utilizing the example first described above, it can be see that for each pair of wall portions, for example, 93 cans of product may be loaded. Thus, for the configuration shown in FIG. 1, there are a total of five four-deep serpentine racks providing a capacity for this particular machine of 465 cans or containers of product P1 through P4.

By proper selection of which columns C1-C4 or IC1-IC4 include the various products, the number of containers of a given product can be matched to the vend rate established by the marketplace. This will minimize the tendency of the supply of a given product to become exhausted for ahead of the supply of other products in a given multi-product machine. In the simplest case illustrated herein, of the 495 containers of product, there would be 95 containers of product P1, 110 containers of product P2, 120 containers of product P2, 120 containers of product P3 and 140 containers of product P4. Various other permutations and combinations of products can readily be made by mixing columns and products among the vending modules. Then, these selections are coordinated with the conventional vend select mechanisms and controls of the vending machine in a manner known in the art.

The present invention having been thus described, it should be apparent that modifications could be made to the various components of the system, as would occur to one of ordinary skill in the art without departing from the spirit and scope of the present invention.

We claim:

1. A vend rack structure for product vending machines for delivering vendable products from a top loading position to a bottom dispensing position in a vending machine, comprising:

upright hollow wall portions having first means defining a plurality of serpentine paths thereon over a major extent of the vertical dimension thereof;

said first means comprises hollow bosses extending outward from each said wall portion and having surfaces thereon defining said serpentine paths and having the interior of said hollow bosses being in communication with the interior of said hollow wall portion from which said bosses extend;

second means defining a plurality of canted substantially horizontal chutes on said wall portions stacked one above the other and interconnecting the upper ends of respective ones of said serpentine paths to said top loading position at one side of said wall portion;

bracket means in said vending machine for slidably receiving each of said wall portions, permitting selective removal and replacement thereof in said vending machine;

said serpentine paths on adjacent ones of said wall portions being mirror images of one another, defining product columns extending from said loading position to said dispensing position, such that vendable products are supported therebetween to traverse said product columns from said loading position to said dispensing position;

said bracket means being adjustable lateral of said wall portions such that said product columns defined therebetween will accommodate vendable products of selected lengths;

port means formed in selected ones of said bosses connecting the interior thereof with said product columns over a predetermined portion thereof above said bottom dispensing portion;

flow means for predetermining flow of refrigerated air upward through said hollow wall portions and bosses and out through said port means for cooling a selected portion of said vendable products in said product columns prior to vending the same; and a refrigerated plenum having a ported top plate portion, and circulation means in said plenum for forcing refrigerated air through said ported top plate portion;

said bracket means including brackets, for slidably retaining the bottom ends of said wall portions, mounted on said top plate portion; and said flow means comprising open bottom portions in said upright hollow wall portions and port means in said bracket means permitting said refrigerated air to flow therethrough and into said open bottom portions of said upright hollow wall portions.

2. The combination of claim 1, wherein:

said upright hollow wall portions include internal partition means a predetermined distance above the bottom portions for precluding the flow of air beyond said predetermined distance; and said selected ones of said bosses and said selected portion of said vendable products are those below said internal partition means.

3. A vend rack structure for product vending machines for delivering vendable products from a top loading position to a bottom dispensing position in a vending machine, comprising:

upright hollow wall portions having first means defining a plurality of serpentine paths thereon over a major extent of the vertical dimension thereof;

said first means comprising hollow bosses extending outward from said wall portions and having the interior thereof in communication with said hollow wall portions;

second means defining a plurality of canted substantially horizontal chutes on said wall portions stacked one above the other and interconnecting the upper ends of respective ones of said serpentine paths to said top loading position at one side of said wall portion;

said serpentine paths on adjacent ones of said hollow wall portions defining serpentine product columns extending from said top loading position to said bottom dispensing position;

port means formed in selected ones of said bosses connecting the interior thereof with said product columns over a predetermined portion thereof above said bottom dispensing position;

flow means for permitting a flow of refrigerated air upward through said hollow wall portions and bosses and out through said port means for cooling a selected portion of said vendable products in said product columns prior to vending same;

a refrigerated plenum having a ported to plate portion;

circulation means in said plenum for forcing refrigerated air through said ported top plate portion; and bracket means for retaining the bottom ends of said wall portions, mounted on said top plate portion;

said flow means comprising open bottom portions in said bracket means permitting said refrigerated air to flow therethrough and into said open bottom portions in said upright hollow wall portions and port means in said bracket means permitting said refrigerated air to flow therethrough and into said open bottom portions of said upright hollow wall portions.

4. The combination of claim 3, wherein:

said upright hollow wall portion includes internal partition means a predetermined distance above the bottom portion thereof for precluding the flow of refrigerated air internally of said upright hollow wall portion beyond said predetermined distance; and said selected ones of said bosses and selected portion of said vendable products are those below said internal partition means.

* * * * *